US006032764A

United States Patent [19]

Ferrisi et al.

[11] Patent Number: 6,032,764

[45] Date of Patent: Mar. 7, 2000

[54] ROLLER GUIDE ASSEMBLY WITH SOUND ISOLATION

[75] Inventors: John J. Ferrisi, Southington, Conn.; Akihiro Hasegawa, Inagi, Japan; James A. Rivera, Bristol; Bruce P. Swaybill, Farmington, both of Conn.

[73] Assignee: Otis Elevator Company, Farmington, Conn.

[21] Appl. No.: 09/015,174

[22] Filed: Jan. 29, 1998

Related U.S. Application Data

[63] Continuation-in-part of application No. 08/988,691, Dec. 11, 1997, Pat. No. 5,950,771.

[51] Int. Cl.[7] ..... B66B 7/04

[52] U.S. Cl. ..... 187/410

[58] Field of Search ..... 187/410, 406, 187/414; 104/245

[56] References Cited

U.S. PATENT DOCUMENTS 5,107,963 4/1992 Rocca et al. ..... 187/410

FOREIGN PATENT DOCUMENTS 0 695718 A2 2/1996 European Pat. Off. .
0695718 2/1996 European Pat. Off. .
1406209 10/1968 Germany .

OTHER PUBLICATIONS

PCT Search Report for Serial No. PCT/US98/12163 dated Aug. 13, 1998.

*Primary Examiner*—Kenneth W. Noland

[57] ABSTRACT

A roller guide assembly for an elevator system includes a plurality of rollers and a damping subassembly. The damping subassembly includes a plurality of dampers and a sound isolation mechanism. The sound isolation mechanism interconnects the dampers and provides sound isolation between the rollers and the elevator car. In a particular embodiment, the sound isolation mechanism includes a friction bar that interconnects the rollers and dampers.

10 Claims, 3 Drawing Sheets

FIG.3
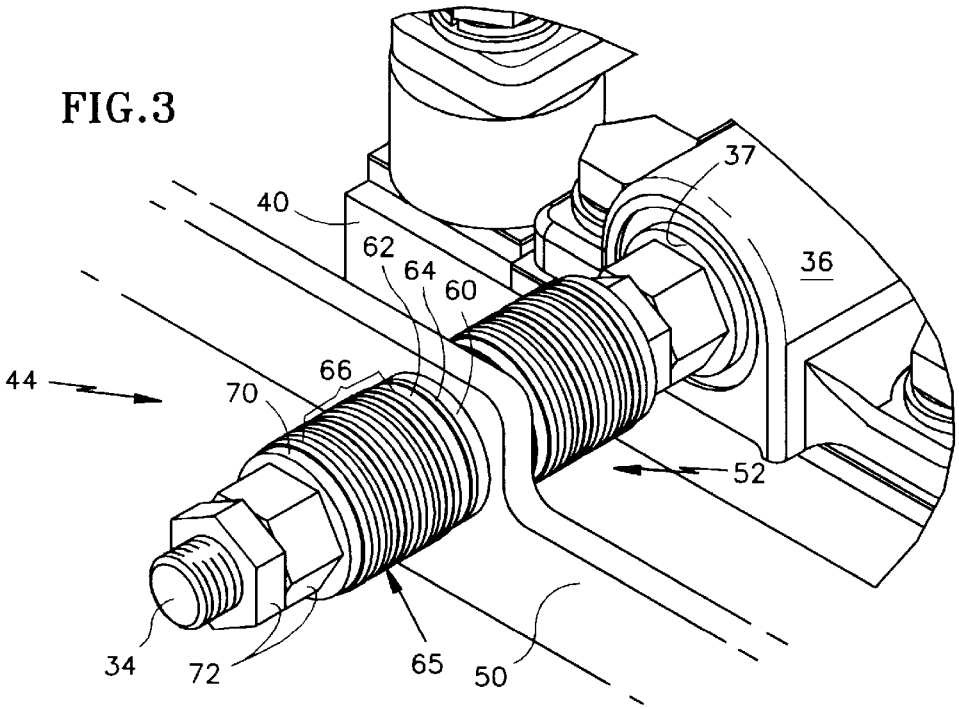
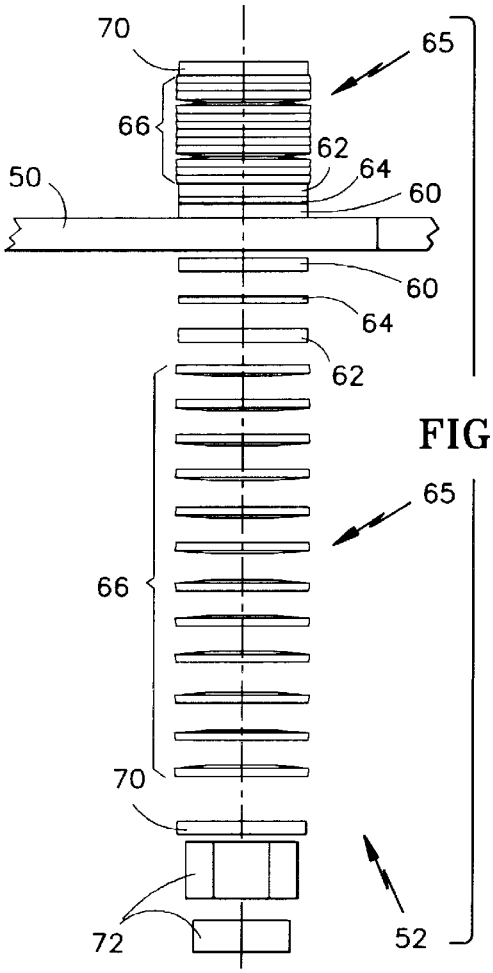
FIG.4
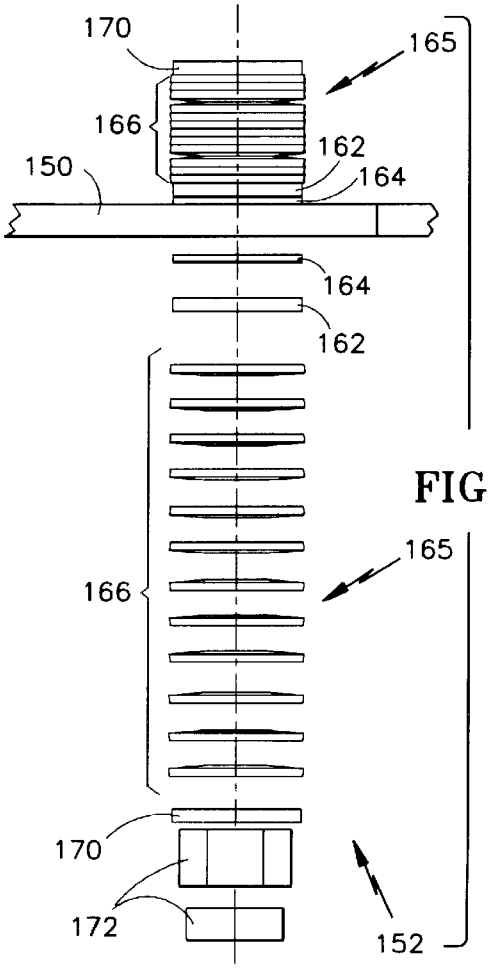
FIG.5

ROLLER GUIDE ASSEMBLY WITH SOUND ISOLATION

CROSS-REFERENCE TO RELATED APPLICATION

This application is a continuation-in-part of prior patent application Ser. No. 08/988,691 entitled "Roller Guide Friction Damper", filed Dec. 11, 1997 and assigned to Applicants' Assignee now U.S. Pat. No. 5,590,771. This application is incorporated herein by reference.

TECHNICAL FIELD

The present invention relates to elevator systems and, more particularly, to roller guide assemblies for such systems.

BACKGROUND OF THE INVENTION

A typical elevator system comprises an elevator car and a counterweight, each suspended on opposite ends of hoist ropes which are disposed in an elevator hoistway. The elevator system also includes at least two sets of guide rails extending the length of the elevator hoistway, with each set of guide rails being disposed on opposite sides of the hoistway. The guide rails guide a plurality of roller guides attached to the elevator car. Besides guiding the elevator car up and down the hoistway, the roller guides ensure a smooth ride of the elevator car by isolating the elevator car from excitation and leveling the elevator car within the hoistway.

There are several factors that impact the quality of the elevator car ride. One such factor is the total length of the hoistway. Longer hoistways require a greater number of guide rail segments stacked within the hoistway and a greater number of joints between the guide rail segments. A greater number of guide rail segments results in greater total weight of the guide rails and the resultant loading causes the rails to deflect. Also, the joints between the guide rails result in some discontinuity. Even slightly deflected rails and minimal discontinuity in joints cause the elevator car to vibrate and move laterally.

Another factor that adversely affects ride quality is an aerodynamic consideration. During vertical travel of an elevator car within the hoistway, aerodynamic car pulses created when the car passes the hoistway doors and/or counterweight cause lateral movement and vibration in the elevator car.

To minimize the adverse impact of rail imperfections and aerodynamics on the ride quality of the elevator car, a conventional roller guide assembly includes a suspension system and a damping system. The suspension system typically comprises a spring associated with each roller of the roller guide assembly to restore the roller to its original position after the roller has been deflected by imperfections in the guide rails. It is desirable to have a relatively soft suspension system to isolate the elevator car from rail imperfections.

Existing damping systems comprise a hydraulic cylinder to reduce vibration. However, the hydraulic damping system increases the stiffness of the suspension system. Increased stiffness of the suspension system is not desirable because of the resulting increase in guide rail excitations transmitted to the car, which in turn increases the vibrational response. Additionally, hydraulic damping systems require regular maintenance, sustain wear, and increase cost of the overall system.

Although the conventional roller guide assemblies are sufficient to ensure a relatively smooth ride for a typical elevator, high rise buildings and a continuous desire for improved ride quality demand improvements to the existing roller guide assemblies. Existing systems are not compatible with higher speed elevator cars riding on much longer stacks of guide rails because the higher speeds of the elevator car amplify aerodynamic factors and longer guide rail stacks increase loading impact. Therefore, a roller guide with a soft suspension system and an improved damping system are desired.

DISCLOSURE OF THE INVENTION

It is an object of the present invention to improve ride quality in high rise elevator systems.

It is another object of the present invention to minimize vibration and lateral movement of an elevator car in high rise elevator systems.

According to the present invention, a roller guide assembly for an elevator system includes an element that isolates the roller guides from the car frame. The isolation minimizes the vibration that is transferred from the roller guides to the car frame and improves the ride quality. In a particular embodiment, the roller guide assembly includes a friction bar, a friction damper disposed on a shaft of each roller in the roller guide assembly, and a bushing to support the shafts. The friction bar interconnects the shafts of the rollers and provides a stationary surface for friction generation for the friction dampers. As a result of the friction bar and the bushing, the shafts are not grounded to the base of the roller guide assembly and, as a result, the shafts are isolated from the base and, therefore, the car frame.

The foregoing and other advantages of the present invention become more apparent in light of the following detailed description of the exemplary embodiments thereof, as illustrated in the accompanying drawings.

BRIEF DESCRIPTION OF THE DRAWINGS

FIG. 3 is an enlarged, partial perspective view of the friction damping subassembly of FIG. 2;

FIG. 4 is a partially exploded side view of a friction damper of the friction damping subassembly of FIG. 3; and FIG. 5 is a partially exploded side view of an alternate embodiment of the friction damper of the friction damping subassembly of FIG. 3.

BEST MODE FOR CARRYING OUT THE INVENTION

Figure 1:
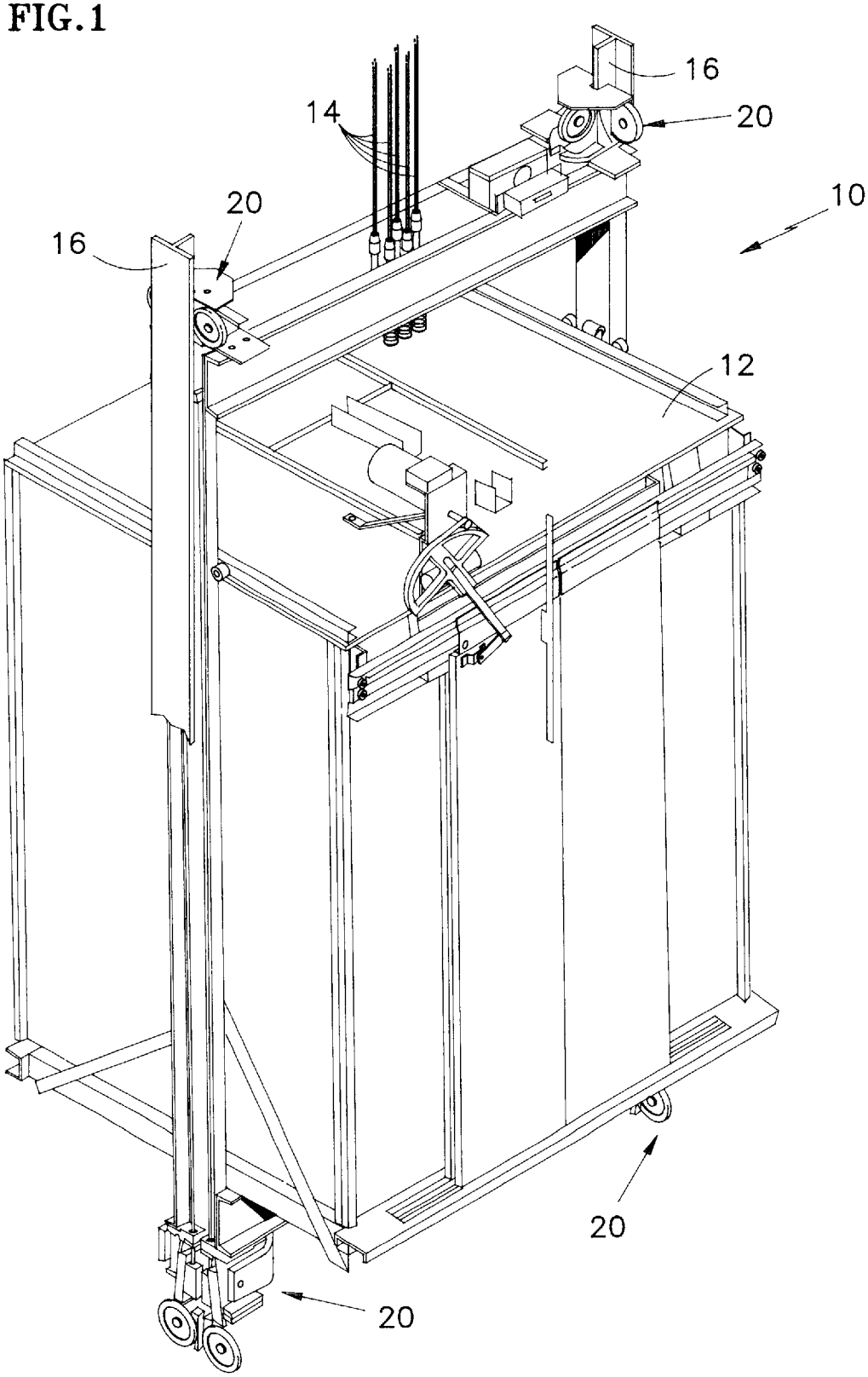
FIG. 1 is a simplified, perspective view of an elevator car with a plurality of roller guide assemblies attached thereto.

Referring to FIG. 1, an elevator system 10 includes an elevator car 12 suspended from hoistway ropes 14 and riding along guide rails 16. A plurality of roller guide assemblies 20 engage the guide rails 16.

Figure 2:
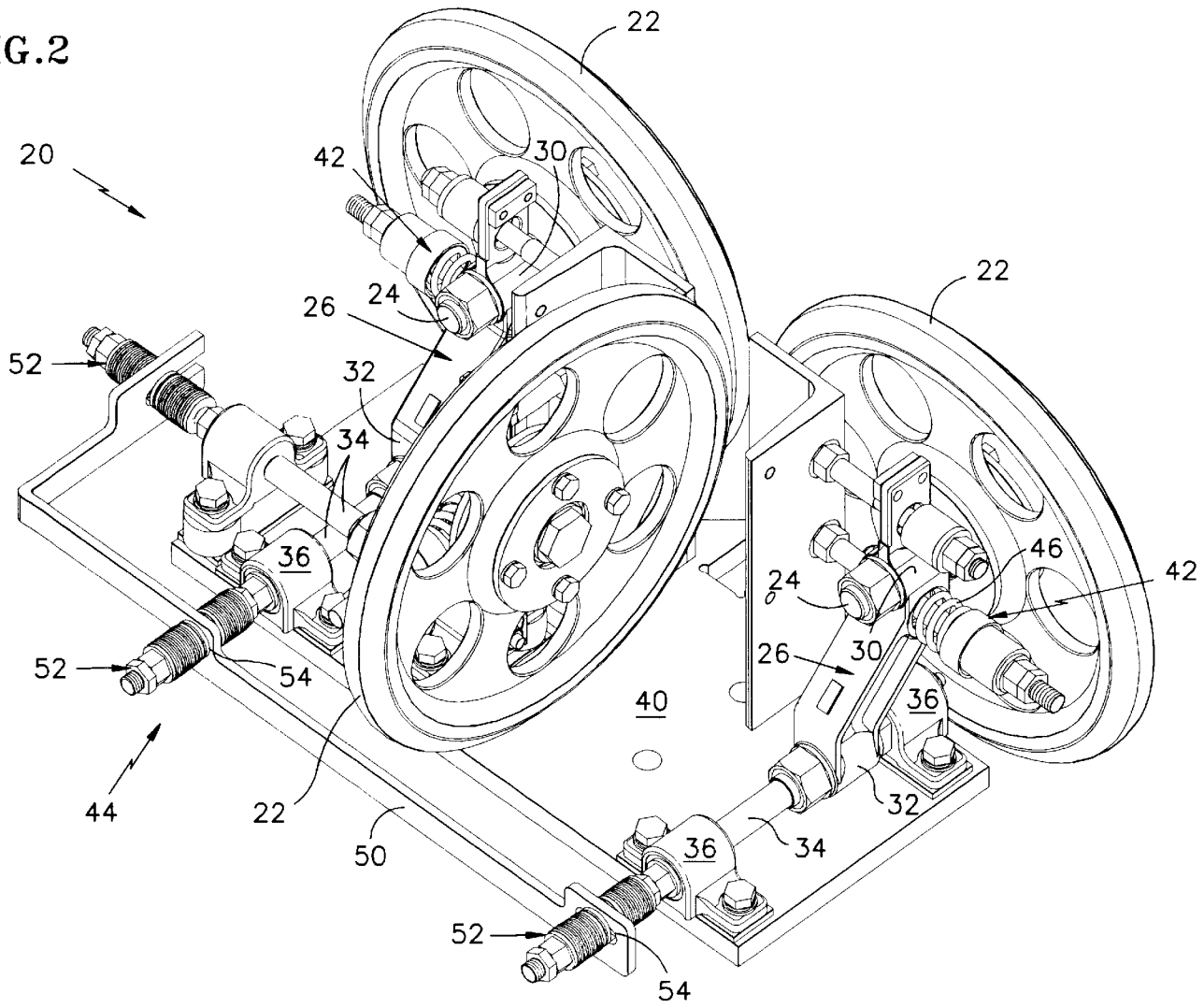
FIG. 2 is an enlarged, perspective view of the roller guide assembly of FIG. 1 with a friction damping subassembly mounted thereon, according to the present invention.

Referring to FIG. 2, each roller guide assembly 20 includes a plurality of rollers 22 that engage the guide rail 16. Each roller 22 includes a roller axle 24 passing through a center of the roller and a translating lever arm 26 with a first arm end 30 fixedly attaching to the roller axle 24 and with a second arm end 32 fixedly attaching to a pivoting shaft 34. The pivoting shaft 34 rotates within bushings 36 which are fixedly attached to a base 40 of the roller guide assembly 20.

Each roller guide assembly 20 also includes a suspension subassembly 42 and a friction damping subassembly 44. The suspension subassembly 42 includes a restoring spring 46 pressed against the first arm end 30 of the lever arm 26. The friction damping subassembly 44 includes a friction bar 50 and a plurality of friction dampers 52. The friction bar 50 includes a plurality of openings 54 and is shaped such that each of the plurality of openings 54 fits onto a respective pivoting shaft 34. Each friction damper 52 is disposed on the outwardly extending threaded end of the pivoting shaft 34 of each roller 22.

Referring to FIGS. 3 and 4, in the best mode embodiment, each friction damper 52 is substantially symmetrical about the friction bar 50 and includes a pair of first washers 60 adjacent to each side of the friction bar 50, a pair of second washers 62 disposed outward of the first washers 60 with a low friction washer 64 sandwiched between the first and second washers 60, 62 on each side of the friction bar 50. The friction washer 64 includes a layer of low friction coating on a side adjacent to the first washer 60. A spring mechanism 65, comprising a plurality of coned disk springs 66, is disposed outward of each second washer 62, as best seen in FIG. 4. A third washer 70 is disposed outward of the plurality of coned disk springs 66 with a pair of nuts 72 terminating the friction damper subassembly on each side of the friction bar 50.

In operation, as the elevator car 12 moves up and down the hoistway, each roller guide assembly 20 engages the corresponding guide rail 16 and is guided thereby, as best seen in FIG. 1. As the roller guide assemblies 20 of the elevator car ride along the guide rails 16, each roller 22 rotates about the roller axle 24, as best seen in FIG. 2. Each roller 22 is subjected to vibrations and lateral movements as a result of imperfections associated with the guide rails 16 and as a result of aerodynamic effects within the hoistway. The lateral movement of each roller 22 results in movement of the corresponding lever arm 26, which is fixedly attached to the roller axle 24. The pivoting shaft 34, fixedly attached to the second arm end 32 of the lever arm 26, then rotates within the bushings 36.

As the lever arm 26 deflects, the restoring spring 46 forces the lever arm 26 and consequently the corresponding roller 22 into its original position. With the rotation of the pivoting shaft 34, the friction washer 64 and the second washer 62 rotate around the shaft 34, moving relative to the first washer 60, as best seen in FIGS. 3 and 4. Resulting friction between the first washer 60 and the friction washer 64 dissipates energy and minimizes vibrations. The relative movement between the first washer 60 and the friction washer 64 becomes possible because the spring mechanism 65 forces the friction washer 64 against the first washer 60. The nuts 72 are tightened and adjusted to ensure that sufficient compression of the spring mechanism is provided.

In the preferred embodiment depicted in FIGS. 3–4 and described above, the first washer 60 protects the friction bar 50 from wear. The friction between the friction bar 50 and the first washer 60 essentially prevents relative movement therebetween and dissipation of energy occurs primarily between the first washer 60 and the friction washer 64. The first washer 60 also ensures structural integrity of the friction damper 52.

Referring to FIG. 5, an alternate embodiment of the friction damper 152 of the present invention comprises a friction washer 164 adjacent directly to the friction bar 150 and the second washer 162. In this alternate embodiment, dissipation of energy occurs between the friction bar 150 and the friction washer 164. In a further embodiment, the friction washer 164 is coated with low friction coating on the side adjacent to the second washer 162. Therefore, dissipation of energy occurs between the friction washer 164 and the second washer 162.

The friction bar 50 of the friction damping subassembly 44 functions as a ground point. In the preferred embodiment, the friction bar 50 ensures that the absorbed energy is not transmitted back to the roller guide assembly 20. In addition, the friction bar 50, in conjunction with the bushings 36, which incorporate a sound isolating material 37 such as rubber, provides sound isolation between the plurality of rollers 22 and the car 12. The friction bar 50 interconnects the three shafts 34 without grounding the shafts 34 to the base 40. This arrangement minimizes the transmission to the car 12 of vibration that results when the rollers 22 engage the guide rails 16.

Although the use of such a friction bar is particularly advantageous with the configuration shown in FIGS. 1–5, it should be understood that the sound isolation mechanism provided by the friction bar may also be applied to other roller guide assemblies, with or without the friction dampers 52. In addition, the specific shape of the friction bar 50 and the shapes of the openings 54 are selected to facilitate assembly of the bar 50 and the roller shafts 34. The shapes of the friction bar 50 and the openings 54 may be varied to accommodate the configurations of other roller guide assemblies.

The low friction coating of the friction washer is a polytetrafluroethylene compound, such as Teflon® (a registered trademark of DuPont), or other materials having similar characteristics.

The friction damping subassembly of the present invention reduces vibrations without increasing stiffness of the suspension system. This allows the roller guide assembly to retain a relatively soft suspension system, which is imperative for a smooth ride. The friction damping subassembly has a number of additional advantages over the conventional hydraulic dampers. One advantage is lower cost. Another advantage is less wear. A further advantage is that the friction damping subassembly of the present invention does not require regular maintenance. Additionally, the friction damping subassembly does not require continuous adjustments.

While the present invention has been illustrated and described with respect to a particular embodiment thereof, it should be appreciated by those of ordinary skill in the art, that various modifications to this invention may be made without departing from the spirit and scope of the present invention. For example, although the best mode embodiment discloses the spring mechanism 65 comprising a plurality of coned disk springs 66, other types of springs could be used.

We claim:

1. A roller guide assembly for an elevator system having an elevator car, said roller guide assembly including a plurality of rollers engaged with a damping subassembly, said damping subassembly including a plurality of dampers and a sound isolation mechanism, wherein the sound isolation mechanism interconnects the dampers and provides sound isolation between the rollers and the elevator car, and wherein the sound isolating mechanism is a bar that interconnects the dampers and the rollers.

2. The roller guide assembly according to claim 1, wherein the sound isolation mechanism further includes a bushing engaged with the rollers, the bushing being disposed in a fixed relationship to the elevator car, and wherein the bushing includes a sound isolating material.

3. The roller guide assembly according to claim 1, wherein the dampers are friction dampers, and wherein the bar cooperates with each of the friction dampers to dissipate energy.

4. The roller guide assembly according to claim 1, wherein each roller includes a shaft, wherein each damper is engaged with one of the shafts, and wherein the bar interconnects the plurality of shafts.

5. A roller guide assembly for an elevator system having an elevator car, said roller guide assembly including a plurality of rollers engaged with a damping subassembly, said dawning subassembly including a plurality of dampers and a sound isolation mechanism, wherein the sound isolation mechanism interconnects the dampers and provides sound isolation between the rollers and the elevator car, and wherein the sound isolation mechanism functions as a ground point to block the transmission of absorbed energy back to the roller guide assembly.

6. The roller guide assembly according to claim 5, wherein the sound isolation mechanism further includes a bushing engaged with the rollers, the bushing being disposed in a fixed relationship to the elevator car, and wherein the bushing includes a sound isolating material.

7. The roller guide assembly according to claim 5, wherein the sound isolating mechanism is a bar that interconnects the dampers and the rollers.

8. The roller guide assembly according to claim 7, wherein the dampers are friction dampers, and wherein the bar cooperates with each of the friction dampers to dissipate energy.

9. The roller guide assembly according to claim 7, wherein each roller includes a shaft, wherein each damper is engaged with one of the shafts, and wherein the bar interconnects the plurality of shafts.

10. The roller guide assembly according to claim 5, wherein the dampers are friction dampers.

* * * * *